United States Patent [19]

Stichnoth et al.

[11] 4,391,602

[45] Jul. 5, 1983

[54] PROCESS FOR SMOOTHING AND DRYING WASHED SHAPED ARTICLES OF MIXED FABRIC

[76] Inventors: Otto Stichnoth; Andreas Stichnoth, both of Schiefer Weg 21, 3400 Gottingen, Fed. Rep. of Germany

[21] Appl. No.: 190,078

[22] Filed: Sep. 23, 1980

[30] Foreign Application Priority Data

Oct. 2, 1979 [DE] Fed. Rep. of Germany ..... 2939870

[51] Int. Cl.[3] ..... D06B 3/30

[52] U.S. Cl. ..... 8/149.1; 8/149.3; 68/5 D; 68/20; 223/51

[58] Field of Search ..... 8/149.1, 149.2, 149.3; 68/5 C, 5 D, 5 E, 20; 34/37, 151, 219, 225; 38/1 R, 1 A, 3, 144; 223/51, 70, 73, 76

[56] References Cited

U.S. PATENT DOCUMENTS

| | | | |
|---|---|---|---|
| 3,257,739 | 6/1966 | Wentz | 8/149.2 X |
| 3,644,085 | 2/1972 | Beeley et al. | 8/149.3 X |
| 3,732,628 | 5/1973 | Blevens et al. | 8/149.3 X |

*Primary Examiner*—Philip R. Coe

*Attorney, Agent, or Firm*—Austin R. Miller

[57] ABSTRACT

A process and apparatus are provided for smoothing and drying shaped articles having different fibrous components. In accordance with the disclosed process, the articles, after washing, are hung in the moist state and are heated for a relatively long period while the humidity is carefully regulated to a desired constant level. Subsequently, the articles are mechanically smoothed over a short period of duration by continuously blowing hot air against them uniformly and evenly over the surfaces thereof. The apparatus comprises a steaming chamber and a drying chamber, which are serially arranged and connected by a conveyor or the like to provide transport for the hanging articles. Orifices for introducing steam and nozzles for introducing hot air are provided in the walls of the steaming chamber, and nozzles are provided in the walls of the drying chamber for blowing hot air on the articles. A heat exchanger and a closed hot air circulation system are provided causing hot air passage in counter-current fashion through the individual sections of the drying chamber, then through the steaming chamber and finally through the heat exchanger wherein condensate is removed.

20 Claims, 3 Drawing Figures

PROCESS FOR SMOOTHING AND DRYING WASHED SHAPED ARTICLES OF MIXED FABRIC

FIELD OF THE INVENTION

The invention relates to a process for smoothing and drying washed shaped articles of mixed fabric, wherein the shaped articles are hung in the moist state, steam is blown against them and they are dried in a stream of air. At the same time, the invention pertains to the apparatus utilized for carrying out this process.

BACKGROUND OF THE INVENTION

A mixed fabric is understood as a fabric which partially contains synthetic fibers and partially natural fibers, that is to say in particular, for example 65% of polyester and 35% of cotton. Customarily, overalls, jackets, shirts and similarly shaped articles are manufactured from such mixed fabrics. As a rule, these are work clothes, for example those of technician staff, for example draftsmen workshop garments and also those of physicians and soldiers. Not infrequently, these shaped articles are washed and treated in large laundries, where it is very difficult to inexpensively smooth and dry these shaped articles after washing, so that their proper appearance is restored. After the washing process, mixed fabrics of this type show an extensive formation of creases. These creases and folds must then be removed again from the shaped articles at a later stage. The formation of creases is caused, on the one hand, by the temperature which occur during washing and, on the other hand, by the spinning or pressing steps which take place after the actual washing process in order to remove the water at least partially from the shaped articles.

In order to counter this formation of creases during the washing process, special washing programs which comprise precise instructions regarding the temperatures, water levels in washing drums, cooling periods of the laundry and the like, which are to be maintained, have been developed for mixed fabrics of this type. The salient point of these prescribed washing processes is to avoid rapid changes in temperature. Moreover, the washing machines are loaded only partially so that the capacity of a washing drum is utilized only partially, in order to reduce the extent of the creasing of the shaped articles.

Two different procedures, which, however, both require the observance of special washing instructions are known for the after-treatment of such shaped articles of mixed fabric. These procedures concern smoothing and drying after the washing process. On the one hand, the shaped articles of mixed fabric are, after washing, only slightly spun and are hung up in the moist state. They are then passed through a drying chamber and are dried by a gentle air stream. Any creases present in the shaped articles cannot be removed in this way. The result of this smoothing and drying method depends on the precise observation of the washing instructions and hence on the extent to which the laundry is free from creases at the end of the washing process.

On the other hand, it is also known, while observing a special washing process, to hang up the shaped articles in the wet state and to pass them through a chamber in which steam is gently blown against them. The natural fibers (cotton and the like) thus swell to a greater or lesser extent. Due to the mere weight of the articles, they are stretched downwards, corresponding to gravity, and thus become somewhat smoother. The synthetic fibers are hardly influenced by this process. Subsequently, the shaped articles are dried with warm air. Such equipment does not operate satisfactorily since it involves a compromise between the supplies of moisture and heat. If excessively hot steam is added, the shaped articles dry out too quickly and the swelling of the fibers is inadequate. This method only serves to fix the creases, and smoothing of the shaped articles does not occur. If, however, excessively moist steam is added, there is insufficient heat for bringing the natural and synthetic fibers into a formable state, from which a smoothing process could develop. Even in this noted procedure, the shaped articles are largely creased at the end of the treatment step so that they have an unsatisfactory appearance.

The disadvantages of the known procedures are that the washing programs must be observed precisely. Mechanical dewatering of the shaped articles after the washing program represents an interference in most cases and is therefore not possible. The washing machines can be loaded only to an extent of about 50%. A high heat and power consumption, coupled with long washing times, results. A further disadvantage is that the result of the treatment is strongly dependent on the nature, manufacture and make-up of the shaped articles. Nevertheless, satisfactory results are obtained only under very restricted conditions.

It is the object of the invention to demonstrate a process and equipment, by means of which it is possible successfully to smooth, and to dry, washed shaped articles of mixed fabric, and to do this independently of the preceding washing process and the properties of the shaped article.

SUMMARY OF THE INVENTION

According to the invention these and other objects are achieved in a process of the type wherein the shaped articles are hung in the moist state and are heated for a long period at approximately constant humidity. Subsequently, the articles are mechanically smoothed for a short period by continuously blowing hot air against them. The hot air is distributed evenly over the surfaces of the articles and the articles are thus shaped in the dry state. The essential point here is that the shaped articles are heated for a long period in the moist state without a significant loss of moisture, that is to say without a drying effect, so that not only the natural fibers but also the synthetic fibers are converted into a formable state. Since this requires time, this process step must be carried out over a long period until the shaped articles themselves have in fact everywhere assumed the requisite temperature. To illustrate this, it may be said that the shaped articles are boiled while hung up in the moist state on the hanger. However, once the thermofixed creases and folds, caused by a normal washing process, have then been made formable, the shaped article can be dried with hot air in a relatively short period, during which it is essential to blow air against the shaped article. The air should be distributed over the entire article at such intensity that the shaped article starts a fluttering motion on the hanger, that is to say, it is mechanically smoothed in this way. This mechanical smoothing must be continued until the dry state has been reached. The hot air should not be blown against the articles in such manner as to lead to their being stripped off the hangers.

Preferably, the shaped articles are heated, without drying, for a long period at a temperature which is at least equal to, and preferably higher than the highest temperature reached in the preceding washing process. The shaped articles are maintained at this temperature and humidity. This process step is based on the fact that a crease in a shaped article can be removed by reshaping only at a temperature which is equal to, but preferably higher than, the temperature at which this crease was formed during washing. The humidity also plays an important part. This heating step is carried out in an atmosphere of virtually 100% atmospheric humidity so that a drying effect at this stage of the process is avoided.

Heating is carried out for a period which is approximately 20 times that of the drying step so that this heating process step (at approximately constant humidity) has certain similarities to washing. In a manner of speaking, the shaped articles are, after washing, hung on the hanger in the moist state and once more subjected to a washing step.

The equipment used for carrying out the process has a tunnel, through which the shaped articles hung on hangers are passed. The tunnel wall comprises orifices for blowing steam against the shaped articles and nozzles are provided for blowing air against the shaped articles. According to the invention, the equipment is characterized in that a steaming chamber and a drying chamber are provided in a series arrangement. These chambers are connected to one another via a conveying device for transporting the shaped articles on hangers. Orifices for introducing steam and nozzles for introducing hot air are provided in the wall of the steaming chamber. Distributed over the wall of the drying chamber are nozzles for blowing in hot air. The essential point here is that the steaming chamber on the one hand and the drying chamber on the other hand are adequately separated from one another so that long-period heating at constant humidity in the steaming chamber and short-period drying and mechanical smoothing in the drying chamber can be carried out. In the steaming chamber, humidity and temperature must be made available, that is to say steam must be introduced on the one hand and drying air must also be fed in on the other hand. It is not desirable to direct a strong blow against the shaped articles or to move them. It is sufficient to pass the shaped articles in this warm/humid atmosphere through the steaming chamber. It is to be understood that the humidity in the steaming chamber can be kept constant with the aid of a special regulating and control process, by feeding, if required, superheated steam or saturated steam, or both in an appropriate ratio, into the steaming chamber. Furthermore, drying air, that is to say hot air, is also fed into the steaming chamber.

In the drying chamber, however, the point is to effect drying in the smooth state of the shaped articles in as short a period as possible. In this case, it is essential to direct a strong blow against the shaped articles so that, while hanging on the hanger, they are subjected to an intensive fluttering motion which partially tightens and tensions the fabric.

The steaming chamber has a width suitable for passing the shaped articles on hangers through in the transverse direction, while the drying chamber has a width suitable for passing the shaped articles on hangers through in the longitudinal direction. This arrangement ensures that a substantially longer dwell time is possible in the steaming chamber and that nevertheless all sides of the shaped articles are treated during their short-period passage through the drying chamber. This arrangement also results in the particular advantage that the steaming chamber and the drying chamber can be built side by side so that both chambers may have the same axial length. Of course, the conveying device which connects the steaming chamber and the drying chamber and leads through them, must then be designed with such a division that a substantially lower speed of advance is obtained within the steaming chamber, while the shaped articles pass substantially more rapidly through the drying chamber.

The steaming chamber can consist of a single continuous tunnel which, at the two ends, has locks for passing through the shaped articles on hangers. It is then advantageous to make the walls delimiting the tunnel so close to the shaped articles that a seal in the tunnel is made by the shaped articles themselves.

Appropriately, the drying chamber can be subdivided into a plurality of individual sections, the first and last sections either having a relatively greater axial length or being supplied with a relatively lower rate of air than the other sections. The reason is that special conditions apply here since, when the shaped articles on hangers run into and out of the drying chamber, drying air is initially blown against one side thereof so that there is a risk of the shaped articles being stripped off the hanger by this strong stream of air. In the central sections of the drying chamber, this risk is not present because air is blown against the shaped articles from all sides and they are mechanically smoothed.

Individual sections of the drying chamber can have a device for heating up the hot air which has been extracted from one section and is to be fed to the adjacent section so that the hot air is always reheated per section and fed in afresh. A heating-up device at the run-in section of the drying chamber is superfluous since the hot air at the extraction point in this section still has a temperature which is sufficient for the air to be used subsequently without further heating in the steaming chamber. With particular advantage, a closed hot air circulation is provided which passes in counter-current through the individual sections of the drying chamber, then through the steaming chamber and finally through one or more heat exchangers where condensate is removed. Thus, this closed air stream can be used for drying the air so that no extraneous air is required and the process can proceed economically, utilizing heat recovery. This makes it possible to use energy in an economical manner.

BRIEF DESCRIPTION OF THE DRAWINGS

An illustrative embodiment of the invention is represented in the drawings and is described in more detail in the following text. In the drawings.

DETAILED DESCRIPTION

Figure 1:
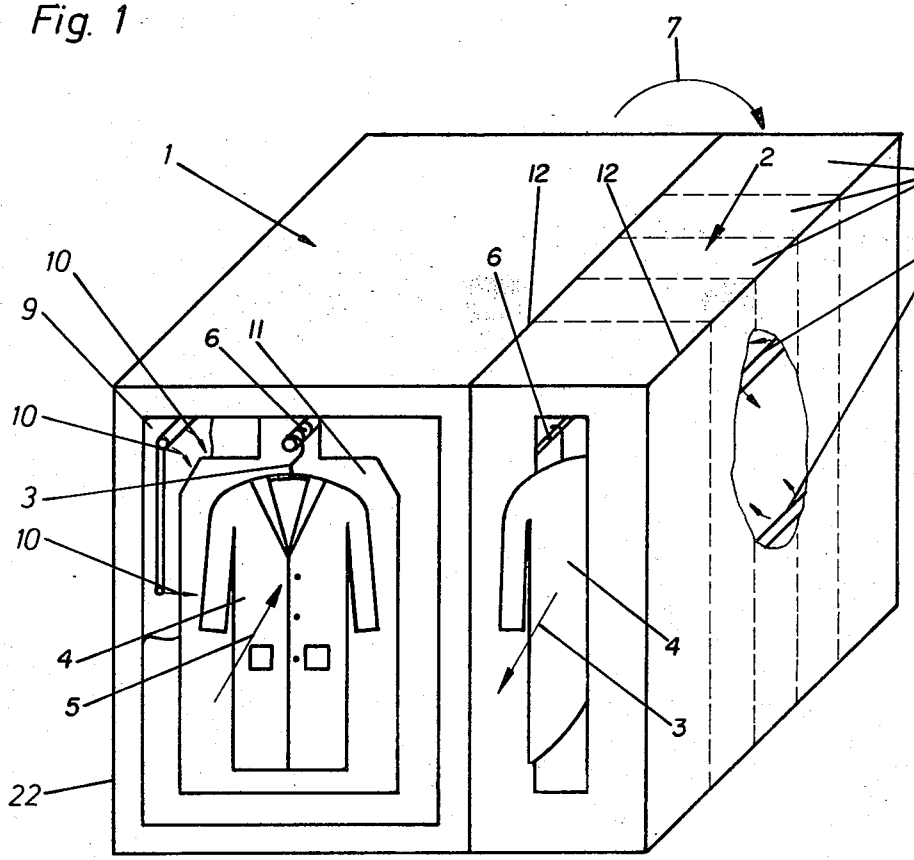
FIG. 1 is a diagrammatic perspective view of the equipment.

FIG. 1 perspectively shows the steaming chamber 1 and the drying chamber 2 side by side. The shaped articles 4 hung on hangers 3 run into the steaming chamber 1. Transport is effected by a conveying device 6 which can be designed as a rotary screw provided with a thread, or as a chain conveyor or the like. At the end of the steaming chamber 1, the conveying device 6 passes out of the latter and directs the shaped articles 4 in the direction of arrow 7. The articles are rotated about 90° and are transported into the drying chamber 2 from which the shaped articles 4 emerge according to arrow 8 in the finished treated state. It will be seen that the shaped articles 4 pass transversely through the steaming chamber 1, the shaped articles migrating one behind the other through the steaming chamber 1 at a very close spacing of, for example, two or three centimeters. At the diversion point shown at arrow 7, the shaped articles 4 are re-hung in such a way that they and the hangers 3 extend substantially in the axial direction of the drying chamber 2. This different passage direction of the shaped articles 4 is important to the process. In the steaming chamber 1, the goal is merely to reach the necessary temperature at the shaped articles 4, while maintaining the humidity or introducing moist steam. In the drying chamber 2, however, a mechanical smoothing process takes place which is carried out by strongly blowing dry air against the shaped articles 4 so that the formable fabric is tightened, smoothed and at the same time dried. For these purposes, a channel or pipe is formed in the walls 9, in particular in the side walls of the steaming chamber 1, so that saturated steam and/or superheated steam may be supplied. Hot air can be introduced via orifices and via a distribution system consisting of pipes and the like. Steam and air flow relatively slowly according to the arrows 10 into the interior 11 of the steaming chamber 1, so that the shaped articles 4 are heated here for a long period at approximately constant humidity.

In the drying chamber 2, the walls 12 thereof are analogously provided with a system of nozzles 13 in a distributed arrangement, through which hot air is blown against the shaped articles 4. The distribution of the nozzles 13 can be such that about 50% of the air is blown in from above and about 50% is blown in at the height of the patch pockets of the overalls. The drying chamber 2 is sub-divided into several sections 14, each having a separate nozzle system 13. The first and last sections of the drying chamber 2 either have a relatively greater axial length or are supplied with less drying air than the other sections since in these sections, hot air is blown against one side of a shaped article 4 hung on a hanger 3 so that care must be taken here to prevent stripping of the shaped article 4 from the hanger 3. In the central sections 14 of the drying chamber 2, however, the shaped article 4 can and should be fully subjected to the drying air, and it is possible to blow air in at about 4,000 $m^3$/hour per central section 14.

Figure 2:
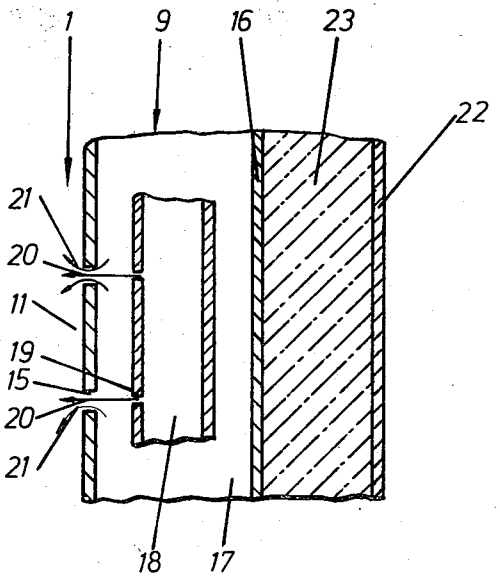
FIG. 2 is a partial side sectional view of the wall of the steaming chamber and, FIG. 3 is a block diagram which is intended to clarify the respective paths of air and steam which may be utilized in accordance with the invention.

FIG. 2 diagrammatically shows the wall 9 of the steaming chamber 1. Orifices 15 are provided in the wall 9. Between the inner wall with the orifices 15 and a central wall 16, a channel cross section 17 is formed, into which superheated steam and/or saturated steam are fed. In this channel cross section 17, a pipe system 18 is arranged, the nozzles 19 of which are aligned with the orifices 15. In the pipe system, 18, hot air is blown out according to the arrows 20 in such a way that this air passes through the orifices 15 into the interior 11 of the chamber. According to the injector principle, superheated steam and/or saturated steam is thus also drawn in or also carried over into the interior 11 of the chamber as shown by the arrows 21. Between the central wall 16 and the outer wall 22, an insulating layer 23 is provided.

Figure 3:
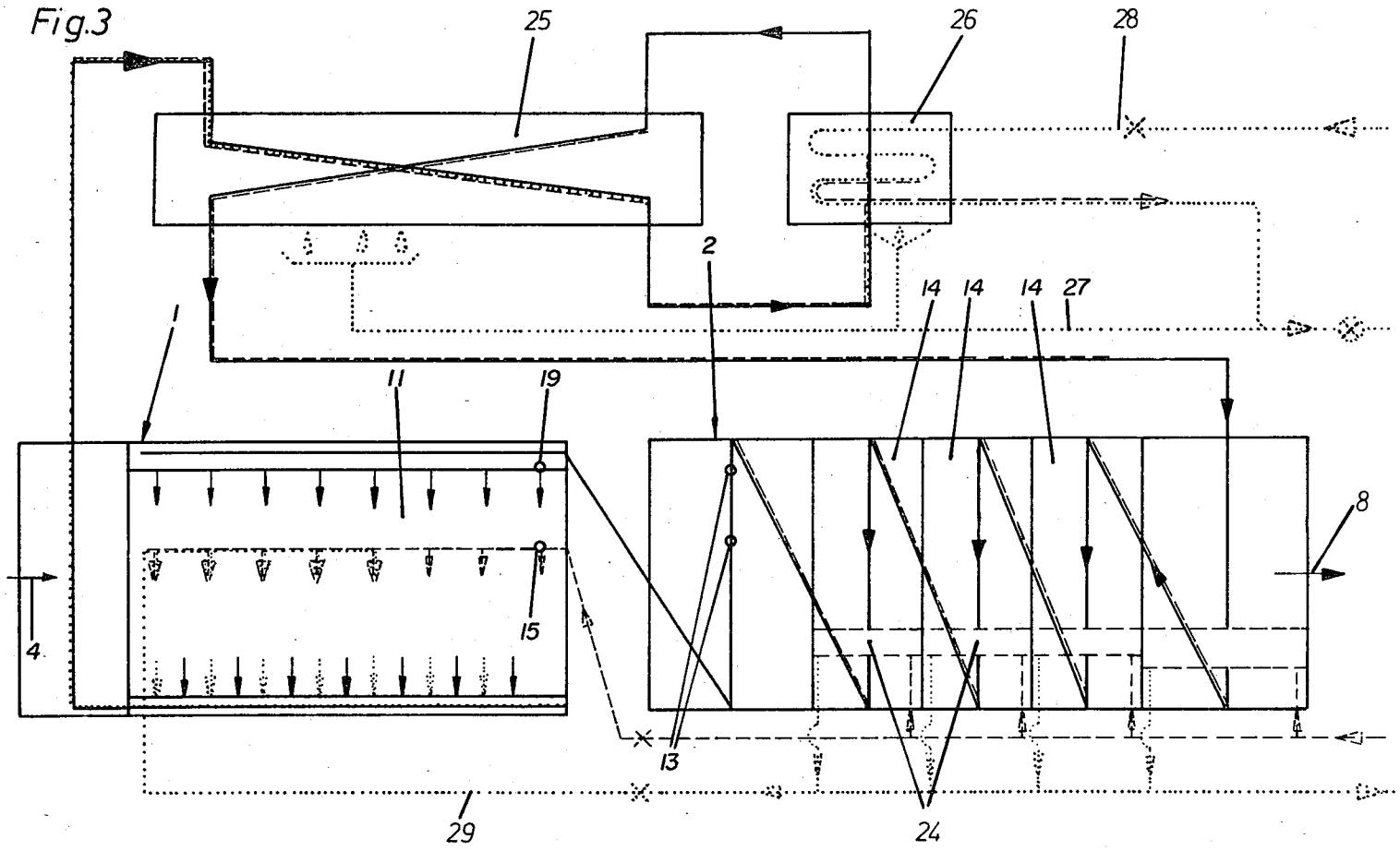

FIG. 3 diagrammatically shows the steaming chamber 1 and the drying chamber 2 with its individual sections 14. The shaped articles pass through these chambers 1, 2 in the direction of the arrows 4, 8. The individual sections 14, with the exception of that at the inlet of the drying chamber 2, are each provided with a heating device 24 which is heated by superheated steam of, for example, ten bar. A closed air circulation is formed which additionally passes through a heat exchanger 25 and a dryer/ cooler 26. The warmed hot air is initially passed in counter-current through the individual sections 14 of the drying chamber 2 and, after extraction from a section 14, it is reheated each time by the heating device 24 and fed to the adjacent section 14. In the section 14 at the inlet side of the drying chamber 2, this stepwise heating is omitted since the hot air is at a sufficient temperature for introducing it into the steaming chamber 1.

The path of the air is shown as a full line. The dashed line indicates the feed of saturated steam or superheated steam, which initially supplies the individual heating devices 24 and then passes to the orifices 15 of the steaming chamber 1, where the steam flows out into the interior 11. Air and condensate are extracted at the bottom of the steaming chamber 1 and are removed. A part of the condensate is separated out in the heat exchanger 25 and is removed via the line 27. The air then flows through the dryer/cooler 26 which is supplied with cooling water from line 28. Subsequently, the air passes again into the heat exchanger 25 where it is heated up. In this heated state, it is blown into the drying chamber 2 at the end on the outlet side. The circulation starts anew.

During practice of the process for smoothing shaped articles of mixed fabric having both synthetic and natural fibers, after the articles are washed at a first temperature, the washed articles are conveyed through a heating chamber, indicated as 11 in FIG. 3, in the direction indicated by arrow 4, until the articles are at a temperature at least equal to the first temperature and are substantially isothermal throughout. Atmosphere within the heating chamber 11 is maintained at a temperature at least equal to the first temperature at which the articles were washed by introduction of steam and air into first chamber 11 as indicated by arrows 20, 21 in FIG. 2. Steam is provided as indicated via dotted line 29 while hot air is provided as indicated by solid line 19, both as shown in FIG. 3. Hot air provided via line 19 comes from a plurality of serially disposed drying chamber sections 14, illustrated in FIG. 3. Drying air is directed at the articles within each of the drying chambers sections 14 to agitate the articles and thereby tighten, smooth and dry the article fabric.

The drying air is introduced first into the drying chamber lastly encountered by the articles as the articles are conveyed through the drying chamber sections. Specifically, the direction of travel of the articles through the steam chamber and the drying chamber sections is shown by arrows 4, 8 in FIG. 3 while direction of travel of the hot drying air is shown by the arrowed solid line passing through each of drying chamber sections 14. Accordingly, it is seen from FIG. 3 that the direction of travel of the hot drying air is opposite to the direction of travel of the articles to be dried through the drying chamber sections. Hence, the stream of drying air is introduced firstly into the drying chamber section lastly encountered by the articles as the articles are conveyed through the drying chamber sections. As indicated by the solid arrowed line in FIG. 3, the drying air is thereafter serially introduced into the drying chamber sections in order reverse from that travelled by the articles during conveyance of the articles through the drying chamber sections.

Intermediate each of the drying chamber sections, the drying chamber air is heated by heat exchange with steam from dotted steam line 29 with heat exchange occurring at heating devices 24 indicated in FIG. 3.

The stream of heated drying air leaving the first drying chamber section, which is the first drying chamber section encountered by the articles during conveyance thereof through the drying chamber, is introduced into the heating chamber as indicated by the solid drying air line drawn diagonally between heating chamber 1 and drying chamber 2, as shown in FIG. 3. This heated drying air is introduced into the heating chamber 1 as high humidity heating air by discharge of this air through a steam environment into the heating chamber as illustrated in FIG. 2, particularly by arrows 20, 21 thereof. The high humidity heating air is then discharged from heating chamber 1 by means of the solid arrowed line connecting heating chamber 1 to heat exchanger 25 as shown in FIG. 3. Within heat exchanger 25, condensate is removed from the high humidity heating air received from heating chamber 1. The high humidity heated air is then transported to dryer cooler 26, as indicated by the solid arrow line in FIG. 3 connecting heat exchanger 25 and dryer cooler 26, in which the high humidity heated air is cooled thereby reducing relative humidity of that air, to produce relatively dry cooler air.

The relatively dry cooler air is then transported from dryer cooler 26 back to heat exchanger 25, as indicated by the solid arrowed line therebetween, where the relatively dry cooler air is heated to produce heated relatively dry air for repeated passage through the drying chamber sections 14. The air is then conveyed to the drying chamber section 14 as indicated by the solid arrowed line connecting heat exchanger 25 with drying chamber 2 which completes the circulation of air around the circuit shown in solid arrowed lines in FIG. 3. This circulation of air around the circuit shown in solid arrowed in FIG. 3 results in the steps performed as the air circulates around the circuit being performed repetitively and serially.

It is to be noted that flow of the drying air is countercurrent to the direction of travel of the articles through the heating and drying chambers. Moreover, heat exchange between the drying air and the steam is a parallel type of heat exchange indicated by the fact that each of the heat exchange devices 24 is connected in parallel with a main steam line 29, as shown in FIG. 3. Accordingly, fresh steam is provided to all heating devices 24 so that drying air introduced to each of the drying chamber sections is at the same, initial high temperature.

The invention being thus described, it will be obvious that the same may be varied in many ways. Such variations are not to be regarded as a departure from the spirit and scope of the invention, and all such modifications are intended to be included within the scope of the following claims.

We claim:

1. A process for smoothing shaped articles of mixed fabric having both synthetic and natural fibers, comprising the steps of:

(a) washing said articles at a first temperature;

(b) conveying said washed articles through a heating chamber until said articles are a temperature at least equal to said first temperature and substantially isothermal throughout;

wherein atmosphere within said heating chamber is maintained at a substantially uniform wet bulb temperature at least equal to said first temperature by introduction of steam and air therein;

(c) drying said heated washed articles by conveying said articles through a plurality serially disposed drying chamber sections and directing drying air at said articles within each of said drying chamber sections at sufficient velocity to agitate said articles and thereby tighten, smooth and dry said fabric by:

i. introducing a stream of drying air first into the drying chamber section lastly encountered by said articles upon conveying through said drying chamber sections and thereafter serially into said drying chamber sections in order reverse from that traversed by said articles during conveyance thereof through said drying chamber sections;

ii. heating said drying air intermediate each of said drying chamber sections of said plurality;

iii. introducing said stream of heated drying air leaving a drying chamber section which is first encountered by said articles during conveyance thereof through said serially disposed drying chamber sections into said heating chamber as high humidity heating air by discharging said stream of heated drying air through a steam environment into said heating chamber;

iv. discharging said high humidity heating air from said heating chamber v. removing condensate from said high humidity heating air;

vi. cooling said high humidity heated thereby reducing relative humidity thereof to produce relatively dry cooler air;

vii. heating said relatively dry cooler air to produce heated relatively dry air for repeated serial passage through said drying chamber sections wherein the steps of element c are performed repetitively and serially in the order recited.

2. A process for smoothing shaped articles of mixed fabric having both synthetic and natural fibers, comprising the steps of:

(a) washing said articles at a first temperature;

(b) suspending said washed articles from support apparatus;

(c) heating said articles by conveying said suspended washed articles through a heating chamber until said articles are heated to a temperature at least equal to said first temperature and become substantially isothermal throughout by maintaining atmosphere within said heating chamber at a wet bulb temperature at least equal to said first temperature by introduction of steam and air therein;

(d) drying said heated washed articles by conveying said suspended articles through a plurality of serially disposed drying chamber sections and directing drying air at said moving suspended articles within each of said drying chamber sections at sufficient velocity to agitate said moving suspended articles by:

i. introducing drying air serially into said drying chamber sections in order reverse from that encountered by said suspended articles during conveyance thereof through said drying chamber sections;

ii. heating said serially traveling drying air intermediate each of said drying chamber sections of said plurality;

wherein said wet bulb temperature of said heating chamber is maintained by (e) introducing said heated drying air leaving a drying chamber section which is first encountered by said articles during conveyance thereof through said serially disposed drying chamber sections into said heating chamber as high humidity heating air by discharging said heated drying air through a steam environment into said heating chamber;

wherein said drying air for introduction into said first drying chamber section is obtained by (f) discharging said high humidity heating air from said heating chamber (g) removing condensate from said high humidity heating air;

(h) cooling said high humidity heated air thereby reducing relative humidity thereof to produce relatively dry cooler air;

(i) heating said relatively dry cooler air to produce heated relatively dry air for repeated serial passage through said drying chamber sections according to substeps i. and ii.

3. The process of claim 2 wherein said heating of said serially travelling drying air is performed by:

(a) supplying heat to said serially flowing drying air between adjacent drying chamber sections by heat exchange with a flow of steam;

and wherein said steam environment is continuously replenished by thereafter (b) providing said flow of steam to said steam environment to replenish same as steam from said steam environment is carried into said heating chamber by heating air as said heating air is discharged thereinto.

4. The process of claim 3 wherein said article heating step further includes a. conveying said suspended washed articles through said heating chamber with said articles suspended crosswise the direction of travel through said chamber;

wherein said drying step further includes b. conveying said suspended articles longitudinally through said drying chamber sections with said articles suspended in a direction parallel to the direction of travel through said drying chamber sections and wherein the process further comprises the step of c. rotating said articles ninety degrees with respect to the direction of travel thereof upon passage from said heating chamber to the first of said serially encountered drying chamber sections.

5. The process of claim 4 wherein said drying step further comprises a. directing hot drying air at only a single side of said articles while within said first and last of the serially encountered drying chamber sections but blowing hot drying air against both sides of said articles within said drying chamber sections intermediate said first and last of said serially encountered drying chamber sections.

6. The process of claim 2 further comprising the step of:

a. heating said high humidity heating air after discharge from said heating chamber while removing condensate therefrom;

wherein said heating step (a) of claim 1 and said heating step (i) of claim 1 are performed within a common heat exchanger utilizing a common source of heat.

7. The process of claim 2 wherein said step of heating said articles within said heating chamber further comprises the step of maintaining said heating chamber atmosphere at substantially 100% relative humidity.

8. The process of claim 7 further comprising the step of retaining said articles in said heating chamber for a length of time approximately twenty times the aggregate period of time said articles are retained within said drying chamber sections.

9. The process of claim 7 wherein the step of heating said articles and maintaining said heat chamber at substantially 100% relative humidity is performed by feeding at least saturated steam into said heating chamber.

10. A process for smoothing shaped articles of mixed fabric having both synthetic and natural fibers, comprising the steps of:

(a) washing said articles at a first temperature;

(b) conveying said washed articles through a closed heating chamber until said articles are a temperature at least equal to said first temperature and substantially isothermal throughout;

wherein atmosphere within said heating chamber is maintained at a substantially uniform wet bulb temperature at least equal to said first temperature by introduction of air thereinto by passage of said air through a steam environment;

(c) drying said heated washed articles by conveying said articles through a plurality of serially disposed drying chamber sections defining a closed drying chamber and directing drying air laterally at said articles within each of said drying chamber sections at sufficient velocity to agitate said articles and thereby tighten, smooth and dry said fabric by:

i. introducing a stream of drying air first into the drying chamber section lastly encountered by said articles upon conveying through said drying chamber sections and thereafter serially into said drying chamber sections in order reverse from that traversed by said articles during conveyance thereof through said drying chamber sections;

ii. serially removing said drying air from said respective drying chamber sections and heating said drying air intermediate each of said drying sections of said plurality; said introducing, removing and heating steps being performed in a closed system without the introduction of substantial additional air;

iii. introducing said stream of heated drying air leaving a drying chamber section firstly encountered by said articles upon conveyance through said drying chamber sections into said heating chamber as high humidity heating air without the introduction of substantial excess air by discharging said stream of heated drying air through a steam environment into said heating chamber;

iv. conveying said high humidity heating air from said heating chamber via a conduit to a heat exchanger;

v. removing condensate from said high humidity heating air in said heat exchanger iv. conveying said high humidity air from which said condensate has been removed via a second conduit to a second heat exchanger vii. cooling said high humidity heated air in said second heat exchanger thereby reducing relative humidity thereof to produce relatively dry cooler air;

viii. conveying said relatively dry cooler air back to said first mentioned heat exchanger via a third conduit;

ix. heating said relatively dry cooler air in said first mentioned heat exchanger to produce heated relatively dry air for repeated serial passage through said drying chamber sections;

wherein the steps of element c. are performed repetitively and serially in the order recited and define circulation of said heating and drying air about a substantially closed circuit open only to said steam environment and passageways for entry and exit of said articles to and from said heating and drying chambers.

11. A process for smoothing shaped articles of mixed fabric having both synthetic and natural fibres, comprising the steps of:

(a) washing said articles at a first temperature;

(b) conveying said washed articles through a heating chamber until said articles are a temperature at least equal to said first temperature and substantially isothermal throughout;

wherein atmosphere within said heating chamber is maintained at least equal to said first temperature by introduction of steam and air therein;

(c) drying said heated washed articles by conveying said articles through a plurality of serially disposed drying chamber sections and directing drying air at said articles within each of said drying chamber sections at sufficient velocity to agitate said articles and thereby tighten, smooth and dry said fabric, said drying air being directed at said articles in first and lastly encountered drying chamber sections at air velocity reduced from that in said drying chamber sections intermediate said firstly and lastly encountered sections, by:

i. introducing a stream of heated drying air first into the drying chamber section lastly encountered by said articles upon conveying through said drying chamber sections and there after serially into said drying chamber sections in order reverse from that traversed by said articles during conveyance thereof through said drying chamber sections;

ii. heating dry air intermediate each of said drying chamber sections of said plurality;

iii. introducing said stream of heated drying air leaving said drying chamber section firstly encountered by said articles during conveyance thereof through said serially disposed drying chamber sections into said heating chamber iv. discharging said high humidity heating air from said heating chamber;

v. removing condensate from said high humidity heating air;

vi. cooling said high humidity heating air; prior to repeated serial passage through said drying chamber sections wherein the steps of element c are performed repetitively and serially in the order recited.

12. A process for smoothing shaped articles of mixed fabric having both synthetic and natural fibers, comprising the steps of:

(a) washing said articles at a first temperature;

(b) suspending said washed articles from support apparatus;

(c) heating said articles by conveying said suspended washed articles through a heating chamber until said articles are heated to a temperature at least equal to said first temperature and become substantially isothermal throughout by maintaining atmosphere within said heating chamber at least equal to said first temperature by introduction of steam and air therein;

(d) drying said heated washed articles by conveying said suspended articles through a plurality of serially disposed drying chamber sections and directing drying air at said moving suspended articles within each of said drying chamber sections at sufficient velocity to agitate said moving suspended articles, said drying air being directed at said articles in firstly and lastly encountered drying chamber sections at air velocity reduced from that in said drying chamber sections intermediate said firstly and lastly encountered sections, thereby tightening, smoothing and drying said fabric, by:

i. introducing drying air serially into said drying chamber sections in order reverse from that encountered by said suspended articles during conveyance thereof through said drying chamber sections;

ii. heating said serially travelling drying air intermediate each of said drying chamber sections of said plurality;

wherein said temperature of said heating chamber is maintained by (e) introducing said heated drying air leaving said drying chamber section firstly encountered by said articles during conveyance thereof through said serially disposed drying chamber sections into said heating chamber;

wherein said drying air for introduction into said first drying chamber section is obtained by (f) discharging said high humidity heating air from said heating chamber;

(g) removing condensate from said high humidity heating air;

(h) cooling said high humidity heated air for repeated passage through said drying chamber sections according to substeps i. and ii.

13. The process of claim 12 wherein said heating of said serially traveling drying air is performed by:

supplying heat to said drying air serially between drying air passage through said drying chamber sections by repeated parallel exchange with serially flowing steam;

14. The process of claim 13 wherein said article heating step further includes a. conveying said suspended washed articles through said heating chamber with said articles suspended crosswise the direction of travel through said chamber;

wherein said drying step further includes b. conveying said suspended articles longitudinally through said drying chamber sections with said articles suspended in a direction parallel to the direction of travel through said drying chamber sections and wherein the process further comprises the steps of c. rotating said articles ninety degrees with respect to the direction of travel thereof upon passage from said heating chamber to the first of said serially encountered drying chamber sections.

15. The process of claim 14 wherein said drying step further comprises:

a. directing hot drying air at only a single side of said articles while within said first and last of the serially encountered drying chamber sections but blowing hot drying air against both sides of said articles within said drying chamber sections intermediate said first and last of said serially encountered drying chamber sections.

16. The process of claim 12 further comprising the steps of:

a. heating said high humidity heating air after discharge from said heating chamber while removing condensate therefrom;

wherein said heating step (a) of this claim 1 and said heating step (i) of claim 1 are performed within a common heat exchanger utilizing a common source of heat.

17. The process of claim 12 wherein said step of heating said articles within said heating chamber further comprises the step of maintaining said heating chamber atmosphere at substantially 100% relative humidity.

18. The process of claim 17 further comprising the step of retaining said articles in said heating chamber for a length of time approximately twenty times the aggregate period of time said articles are retained within said drying chamber sections.

19. The process of claim 17 wherein the step of heating said article and maintaining said heat chamber at substantially 100% relative humidity is performed by feeding at least saturated steam into said heating chamber.

20. A process for smoothing shaped articles of mixed fabric having both synthetic and natural fibers, comprising the steps of:

(a) washing said articles at a first temperature;

(b) conveying said washed articles through a closed heating chamber until said articles are a temperature at least equal to said first temperature and substantially isothermal throughout;

wherein atmosphere within said heating chamber is maintained at least equal to said first temperature by introduction of air thereinto by passage of said air through a steam environment;

(c) drying said heated washed articles by conveying said articles through a plurality of serially disposed drying chamber sections defining a closed drying chamber and directing drying air laterally at said articles within each of said drying chamber sections at sufficient velocity to agitate said articles and thereby tighten, smooth and dry said fabric by:

i. introducing a stream of drying air first into the drying chamber section lastly encountered by said articles upon conveying through said drying chamber sections and thereafter serially into said drying chamber sections in order reverse from that traversed by said articles during conveyance thereof through said drying chamber sections;

ii. serially removing said drying air from said respective drying chamber sections and heating said drying air intermediate each of said drying chamber sections of said plurality by exposing said drying air to heat of steam flowing serially in the same direction as said drying air with respect to said drying chamber sections;

said introducing the stream of drying air, removing and heating steps being performed in a closed system without introduction of substantial additional air;

iii. introducing said stream of heated drying air leaving a drying chamber section firstly encountered by said articles upon conveyance through said drying chamber sections into said heating chamber;

iv. conveying said high humidity heating air from said heating chamber via a conduit to a heat exchanger;

v. removing condensate from said high humidity heating air in said heat exchanger;

vi. conveying said high humidity air from which said condensate has been removed via a second conduit to a second heat exchanger;

vii. cooling said high humidity heated air in said second heat exchanger for repeated passage through said drying chamber sections;

wherein the steps of element c are performed repetitively and serially in the order rectied and define circulation of said heating and drying air about a substantially closed circuit open only to said steam environment and at passageways for entry and exit of said articles to and from said heating and drying chambers.

* * * * *